United States Patent [19]

Herstein et al.

[11] Patent Number: 4,559,022

[45] Date of Patent: Dec. 17, 1985

[54] TOY VEHICLE WITH SIMULATED HEADLIGHTS

[75] Inventors: Barry S. Herstein, Spring Valley; Anthony J. Mondini, New York, both of N.Y.

[73] Assignee: Buddy L Corporation, New York, N.Y.

[21] Appl. No.: 621,719

[22] Filed: Jun. 18, 1984

[51] Int. Cl.[4] ..... A63H 17/28

[52] U.S. Cl. ..... 446/438; 446/219

[58] Field of Search ..... 446/438, 439, 462, 463, 446/470, 485, 219, 484

[56] References Cited

U.S. PATENT DOCUMENTS

| | | | |
|---|---|---|---|
| 4,193,223 | 3/1980 | D'Andrade et al. | 446/438 |
| 4,306,375 | 12/1981 | Goldfarb et al. | 446/462 X |

FOREIGN PATENT DOCUMENTS

| | | | |
|---|---|---|---|
| 2703231 | 8/1978 | Fed. Rep. of Germany | 446/439 |
| 708469 | 5/1954 | United Kingdom | 446/438 |
| 955209 | 4/1964 | United Kingdom | 446/439 |
| 2026331 | 2/1980 | United Kingdom | 446/439 |

*Primary Examiner*—Mickey Yu
*Attorney, Agent, or Firm*—Michael Ebert

[57] ABSTRACT

A toy vehicle having a set of wheels driven through a gear train and a gear shift by a direct-current motor. The motor and a single light bulb shunted thereacross are connectable by way of a switch to a battery power supply. The bulb is placed within the optical inlet of a plastic light guide contoured to define light outlets in the form of a pair of simulated front headlights and a bank of simulated dashboard and gear shift light indicators, whereby the illumination of these outlets is derived from the single bulb. In the automatic mode, with the switch closed, the motor is energized to drive the vehicle, the bulb being concurrently energized to provide a constant level of illumination for all lights. In the manual mode, with the switch open, the player propels the vehicle by hand, causing the turning wheels through the gear train to rotate the motor. The motor then functions as a dynamo to energize the bulb whose light intensity varies to reflect the force applied to the vehicle by the player.

5 Claims, 7 Drawing Figures

TOY VEHICLE WITH SIMULATED HEADLIGHTS

BACKGROUND OF INVENTION

Field of Invention

This invention relates generally to toy vehicles driven by a DC motor energized by a battery supply, and more particularly to a vehicle of this type in which a single light bulb is disposed at the optical inlet of a plastic light guide contoured to define light outlets in the form of a pair of simulated front headlights and a bank of simulated dashboard and gear shift indicators.

Toy vehicles which are driven by a small DC motor operated by a battery are commonplace. It is also known in toy vehicles to use the battery power supply to energize headlight bulbs. And in order to avoid the need for a separate light bulb in each dashboard indicator, it is known to use a common light bulb whose light is directed to a plurality of dashboard indicators by way of optical fibers or light pipes.

One can transmit light from one end of a long glass cylinder to the other without leakage, provided that the light strikes the wall of the cylinder with an angle of incidence greater than the critical angle for total internal reflection. In transmission, light travels through the cylinder in a zig-zag path of successive internal reflections. To convey light without reflection loss, it is necessary that the angle of incidence A exceed the critical angle as expressed by the equation $\sin A = N_2/N_1$; where $N_1$ is the refractive index of the transmission material and $N_2$ that of the outer medium which in the case of a glass cylinder is air.

It is also possible to guide light through a clear plastic block formed of acrylic or other glass-like material, for the index of refraction of this material relative to that of air results in internal reflection. The present invention exploits the optical light guide characteristics of such plastic blocks to provide illumination for simulated headlights and dashboard and gear shift light indicators in a toy vehicle.

SUMMARY OF INVENTION

In view of the foregoing, the main object of this invention is to provide a toy vehicle having simulated headlights as well as dashboard and gear shift light indicators, all of which are formed of a contoured plastic light guide which derives its light from a single light bulb.

More particularly, an object of this invention is to provide a toy vehicle of the above type which is driven by a DC motor operated from a battery supply which also serves to energize the single bulb, so that when the vehicle is caused by the motor to travel over a road surface, all of its simulated lights are then on.

Still another object of the invention is to provide a toy vehicle having several possible modes of operation, so that the player, when he loses interest in one mode, can switch to another and thereby extend the play possibilities of the toy.

Also an object of the invention is to provide a motorized toy vehicle in which the DC motor which drives the wheels of the vehicle is also capable of functioning as a dynamo to energize the single light bulb, in which case the dynamo is driven by the wheels.

Briefly stated, the objects of the invention are accomplished in a toy vehicle having a set of wheels driven through a gear train and a gear shift by a direct-current motor. The motor and a single light bulb shunted thereacross are connectable by way of a switch to a battery power supply. The bulb is placed within the optical inlet of a plastic light guide contoured to define light outlets in the form of a pair of simulated front headlights and a bank of simulated dashboard and gear shift light indicators, whereby the illumination of these outlets is derived from the single bulb. In the automatic mode, with the switch closed, the motor is energized to drive the vehicle, the bulb being concurrently energized to provide a constant level of illumination for all lights. In the manual mode, with the switch open, the player propels the vehicle by hand, causing the turning wheels through the gear train to rotate the motor. The motor then functions as a dynamo to energize the bulb whose light intensity varies to reflect the force applied to the vehicle by the player.

OUTLINE OF THE DRAWINGS

For a better understanding of the invention as well as other objects and further features thereof, reference is made to the following detailed description to be read in conjunction with the accompanying drawings, wherein.

DESCRIPTION OF INVENTION

Structure

Figure 1:
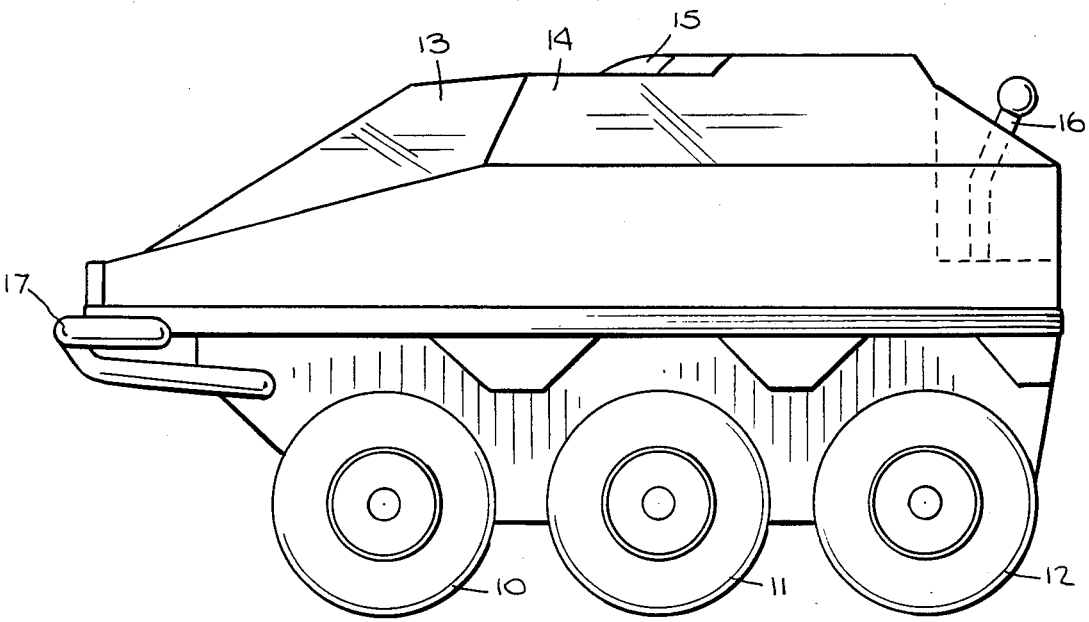
FIG. 1 is a side view of a toy vehicle in accordance with the invention.
Figure 2:
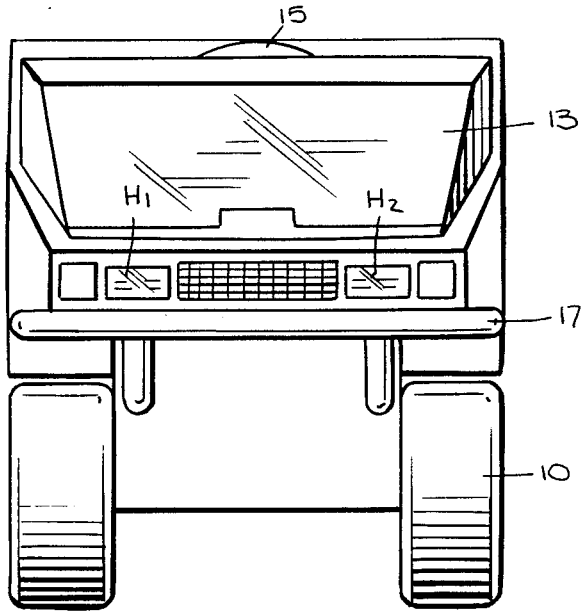
FIG. 2 is a front view of the vehicle.
Figure 3:
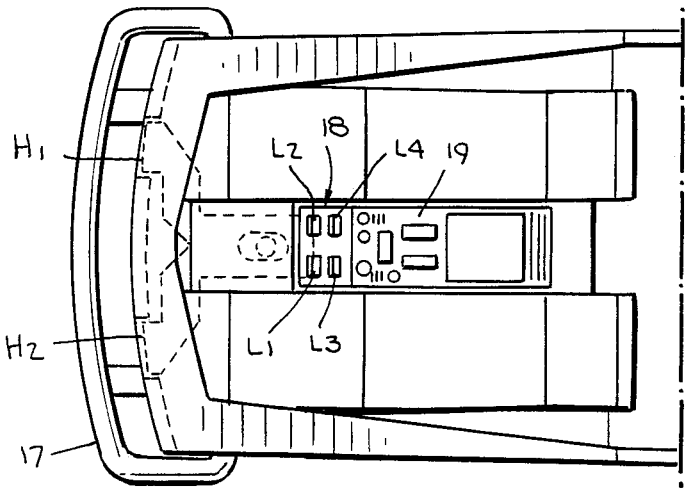
FIG. 3 is a view of the dashboard with the cockpit hood raised.

Referring now to FIGS. 1 to 3, there is shown a toy vehicle in accordance with the invention having three sets of tractor wheels constituted by a driven set 10 of front wheels 10, an intermediate set 11 of idler wheels and a driven set 12 of rear wheels. With this tractor wheel arrangement, the toy functions as an all-terrain vehicle, for it is capable of riding over relatively rough play surfaces and overcoming obstacles in its path.

At the front of the vehicle is a driver cockpit covered by a transparent canopy 13 hinged onto the body 14 of the vehicle. On the roof of the vehicle behind the canopy is a transparent dome 15. In a center alcove at the rear of the vehicle is a gear shift lever 16, shiftable from neutral to a forward or to a reverse position.

Disposed in the front grill of the car above the bumper guard 17 are a pair of simulated headlights $H_1$ and $H_2$. Centered within the cockpit, as shown in FIG. 3 is an inclined dashboard indicator panel box 18 which is integrated with a horizontal gear shift indicator panel box 19. Dashboard panel 18 is provided with a bank of simulated indicator lights $L_1$ to $L_4$, which project upwardly through apertures in the panel. Gear switch panel 19 is provided with simulated indicator lights $L_5$ to $L_7$ which also project upwardly through panel apertures.

Figure 7:
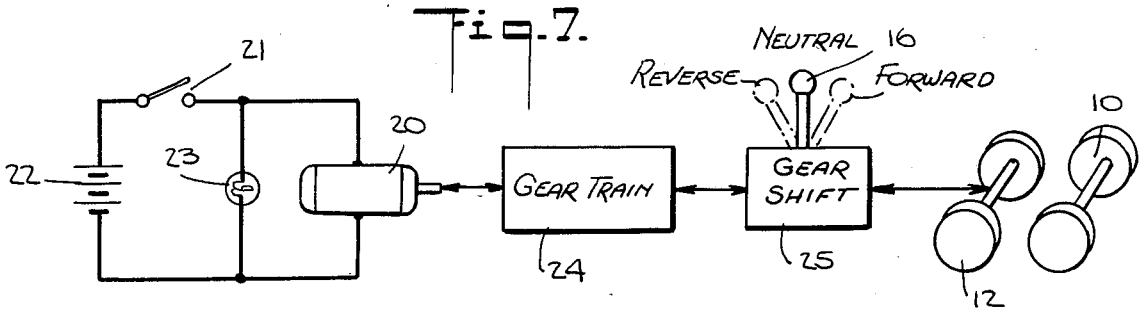
FIG. 7 is a schematic diagram of the electrical and mechanical components of the vehicle.

Within the body of the vehicle is a miniature d-c motor 20, shown schematically in FIG. 7, which is energized through a switch 21 by a battery supply 22 stored in a body compartment. A single light bulb 23 is shunted across motor 20 so that when switch 21 is closed, the bulb as well as the motor is energized.

Motor 20 is operatively coupled through a gear reduction train 24 to the front wheel set 10 and to the rear wheel set 12 by way of a gear shift mechanism 25. When, therefore, switch 21 is closed to supply power to motor 20 and gear shift 16 is in neutral, the wheel sets remain undriven. But when lever 16 is shifted to forward, the front and rear wheel sets are concurrently driven to propel the vehicle in the forward direction. And when lever 16 is shift to its reverse position, the wheel sets are driven to propel the vehicle in the opposite direction.

Figure 4:
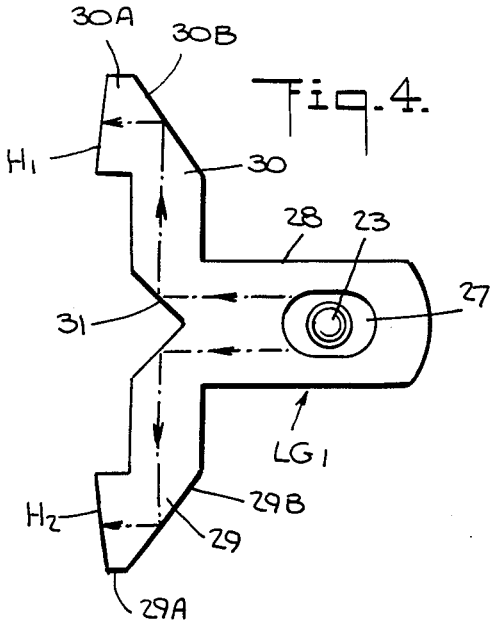
FIG. 4 is a plan view of the light guide headlight section.
Figure 6:
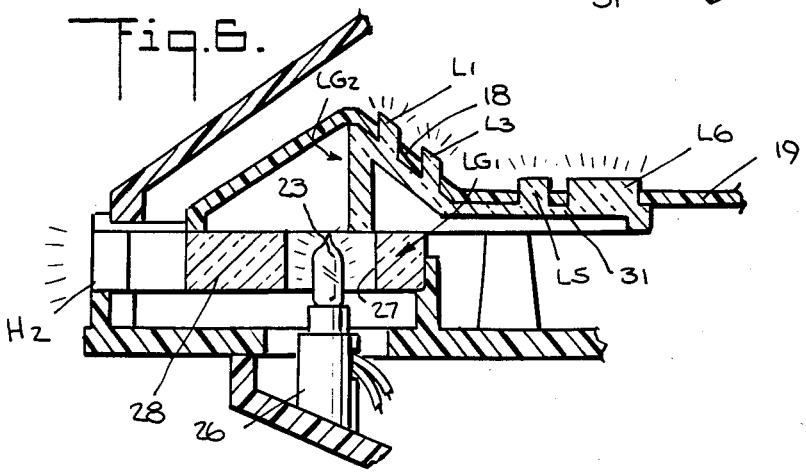
FIG. 6 is a side view showing the relationship of the guide sections to the light bulb.

As shown in FIGS. 4 and 6, light bulb 23 is supported at an upright position in a socket 26 mounted on the vehicle chassis adjacent the front end thereof at a position that is centered with respect to headlights $H_1$ and $H_2$. Bulb 23 projects into an optical inlet 27 of a light guide section $LG_1$ molded of transparent acrylic or other clear plastic material having light conducting properties.

Optical inlet 27 lies within the main block 28 of light guide section $LG_1$, one end of the block being integral with a pair of oppositely-directed legs 29 and 30. The junction 31 of the legs has a V-shaped formation whose faces define internal reflecting surfaces. Legs 29 and 30 terminate in forwardly projecting flat feet 29A and 30A whose faces define the headlights $H_1$ and $H_2$. The legs are provided with inclined faces 29B and 30B which oppose the flat headlight faces $H_1$ and $H_2$, the inclined faces forming internal reflecting surfaces.

Thus, when bulb 23 is energized, light rays therefrom are transmitted as a beam along block 28, as indicated by the arrows in FIG. 4 toward the internal reflective surfaces of junction 31, to provide a split beam. One sub-beam goes through leg 29 to be reflected by the internal surface of inclined face 29B toward headlight $H_2$ which functions as an optical outlet from which the light rays are projected.

In a like manner, the other sub-beam is transmitted toward junction 31 to be directed in leg 30 toward headlight $H_1$ functioning as the second optical outlet. In a light guide, internal reflection at a surface of the guide occurs when the angle at which the light rays are incident to a surface are within the limited range of angles at which reflection occurs, the light otherwise exiting from this surface. In light guide $LG_1$, the geometry is such that internal reflection takes place except at the flat headlight faces $H_1$ and $H_2$, so that most of the light emitted by bulb 23 at the optical inlet is conveyed to the headlights.

Figure 5:
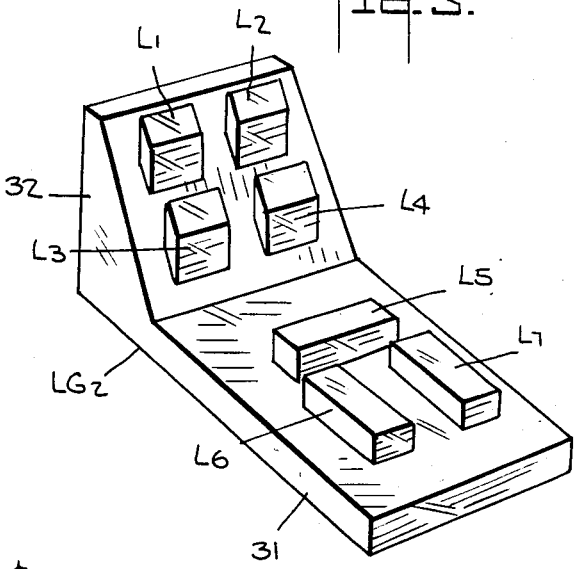
FIG. 5 is a perspective view of the dashboard and gear shift light guide section.

Overlying light guide $LG_1$ is a second light guide $LG_2$. As shown in FIGS. 5 and 6, this section has a rectangular block portion 31 which conforms to and fits within the rectangular gear shift indicator panel box 19, and a trapezoidal portion 32 which conforms to and fits with the inclined dashboard indicator box 18.

The block portion 31 of the light guide section $LG_2$ is provided at its upper face with rectangular projections that define the simulated light indicators $L_5$, $L_6$ and $L_7$, these indicators projecting through rectangular apertures in the gear shift indicator panel. The trapezoidal portion 32 is provided on its inclined face with rectangular projections that define the simulated light indicators $L_1$, $L_2$, $L_3$ and $L_4$, these projecting through rectangular apertures in the dashboard panel. The second light guide sections $LG_2$ is made of the same transparent plastic as the first light guide section, the position of the second section $LG_2$ being such relative to the first section that its rear wall which is adjacent light bulb 23 acts as an optical inlet to convey light to the light indicators $L_1$ to $L_7$. In practice, the two light guide sections may be molded in a unitary form rather than in two separate pieces, as shown.

Operating Modes

A. Freewheeling Mode. The simplest operating mode of the toy is with the switch 21 "off", and with the gear shift lever 16 in neutral, for then the player may himself propel the vehicle as he pleases without motor power.

B. Motorized Mode. With switch 21 "on" and gear shift lever in forward or reverse, the car is motor powered, and the headlights $H_1$ and $H_2$ are "on" as well as the dashboard and gear shift light indicators $L_1$ and $L_7$.

In this mode, the illumination provided by the single bulb 23 connected to battery 22 is at a constant level, and the vehicle, as it travels over the play surface, emits headlight beams and has its cockpit indicator lights "on" to simulate an actual all-terrain operation.

C. Dynamo Mode. In this mode, switch 21 is "off" and gear shift lever 16 is in its forward position. The vehicle can then be propelled forward by the player, in which case the wheel sets 10 and 12 as they rotate act through gear train 24, now operating in reverse in a step-up ratio, to turn the shaft of motor 20 at a relatively high speed.

The motor then functions as a dynamo to generate an output voltage which is applied to bulb 23 which by way of the light guide sections $LG_1$ and $LG_2$ acts to illuminate the headlights and the panel indicator lights.

But in this instance, the amount of illumination depends on how fast the vehicle is propelled by the player. Since the vehicle wheels are geared to the dynamo, it requires some effort to propel the vehicle; the greater the effort exerted by the player, the brighter the illumination. Hence in the dynamo mode, play satisfaction is gained by seeking to attain the greatest possible illumination.

While there has been shown and described preferred embodiments of a toy vehicle with simulated headlights in accordance with the invention, it will be appreciated that many changes and modifications may be made therein without, however, departing from the essential spirit thereof. Thus in practice instead of providing three sets of tractor wheels in an all-terrain model, one may employ the dashboard and headlight light guides in a more conventional model of a four-wheel automobile in which only the front or rear wheel set is operatively coupled to the motor.

We claim:

1. A toy vehicle comprising:

A. front and rear wheel sets;

B. a DC motor operatively coupled to at least one of the wheel sets;

C. a battery connectable to said motor to power same;

D. A single light bulb shunted across the motor, said bulb being energized by the battery when the motor is powered thereby;

E. a first light guide section formed of transparent plastic material having light conducting properties, said guide section being contoured to define a main block having an opening therin forming an optical light inlet which surrounds said bulb and a pair of legs extending in opposite directions from one end of the block, each leg terminating in a forwardly-projecting foot having a flat face disposed at the front of the vehicle to form an optical outlet simulating a headlight, said light guide at the junction of the block and legs being provided with a V-shaped notch forming a pair of opposed reflecting surfaces which cause the light beam from the inlet to split into two sub-beams which are directed into the respective legs, each leg having at its end opposite the flat face an inclined face directing the sub-beam toward the flat face; and F. a dashboard panel having apertures therein through which extend projections from a contoured second light guide section which overlies the first section and also receives light from the bulb, whereby when the headlights are illuminated, so are the projections which act as dashboard light indicators.

2. A vehicle as set forth in claim 1, further including a gear shift panel having apertures therein through which extend projections from said second light guide section to provide gear shift light indicators.

3. A vehicle as set forth in claim 2 wherein said two light guide sections are integrated into a unitary piece.

4. A vehicle as set forth in claim 2, wherein said dashboard and gearshift panels are disposed along the center line of a cockpit in said vehicle.

5. A vehicle as set forth in claim 4, wherein said cockpit is covered by a transparent canopy so that the dashboard and gearshift light indicators are visible to the player.

* * * * *